US008112916B2

(12) United States Patent
Lin et al.

(10) Patent No.: US 8,112,916 B2
(45) **Date of Patent: *Feb. 14, 2012**

(54) ELECTRIC IRON CAPABLE OF QUICKLY COOLING

(75) Inventors: Fangchuan Lin, Tainan (TW); Chihjung Pan, Taipei County (TW); Shihwei Tung, Taipei (TW); Jrren Ji, Taipei (TW); Chiyu Liau, Gilong (TW)

(73) Assignee: Tsann Kuen (Zhangzhou) Enterprise Co., Ltd., Zhangzhou (CN)

( * ) Notice: Subject to any disclaimer, the term of this patent is extended or adjusted under 35 U.S.C. 154(b) by 384 days.

This patent is subject to a terminal disclaimer.

(21) Appl. No.: 12/531,930

(22) PCT Filed: May 8, 2006

(86) PCT No.: PCT/CN2006/000918

§ 371 (c)(1),
(2), (4) Date: Sep. 18, 2009

(87) PCT Pub. No.: WO2007/128164

PCT Pub. Date: Nov. 15, 2007

(65) Prior Publication Data

US 2010/0192426 A1 Aug. 5, 2010

(51) Int. Cl.
*D06F 75/26* (2006.01)
*D06F 75/08* (2006.01)

(52) U.S. Cl. ..... 38/89

(58) Field of Classification Search ..... 38/74–77.9, 38/88, 89, 95; 219/245
See application file for complete search history.

(56) References Cited

U.S. PATENT DOCUMENTS

| | | | | |
|---|---|---|---|---|
| 2,320,013 | A * | 5/1943 | Scharf | 38/79 |
| 2,362,590 | A * | 11/1944 | Smith | 38/75 |
| 5,210,394 | A * | 5/1993 | Kerremans | 219/245 |
| 7,124,523 | B2 * | 10/2006 | Asvadi et al. | 38/93 |
| 7,185,450 | B2 * | 3/2007 | Lin et al. | 38/89 |
| 7,610,701 | B2 * | 11/2009 | Cavada | 38/82 |

FOREIGN PATENT DOCUMENTS

| | | | |
|---|---|---|---|
| CN | 2304681 | Y | 1/1999 |
| CN | 1814902 | A | 8/2006 |
| EP | 1300502 | A1 | 4/2003 |
| JP | 5337299 | A | 12/1993 |
| KR | 20040056758 | A | 7/2004 |

* cited by examiner

*Primary Examiner* — Ismael Izaguirre
(74) *Attorney, Agent, or Firm* — Rabin & Berdo, P.C.

(57) ABSTRACT

An electric iron capable of quickly cooling comprising: an ironing base and a housing, herein a soleplate is disposed on the bottom of the ironing base, while the housing comprising a shell covered on the upside of the soleplate of the ironing base, and a chamber enclosed by the shell. To improve the safety just after using, the present iron is characterized by that the shell is provided with a plurality of vents, and the soleplate is provided with a plurality of cooling fins which is protruded into the chamber, and a fan is installed in the chamber to emit the hot air to the chamber with the aid of the cooling fins, and discharge the hot air from the vent by the running of the fan, so as to cool quickly and improve the safety of the iron just after using.

7 Claims, 4 Drawing Sheets

ELECTRIC IRON CAPABLE OF QUICKLY COOLING

FIELD OF THE INVENTION

The present invention relates to an electric iron and, more particularly, to an electric iron capable of quickly cooling just after using.

BACKGROUND OF THE INVENTION

Conventional electric iron is to mount a ship-shaped ironing base on the bottom of a housing which can be hold, and electric heating coil is provided inside the housing to provide heat to the iron base, thus achieve the object of ironing the cloth, and some electric irons are provided with steam generating device to improve the evenness of the cloth.

No matter the electric irons have steam generating device or not, generally, their iron bases do not have rapid-cooling function. To iron the cloth, the iron bases is generally provided with a temperature between 180~200° C., when the iron stopped use, the user only can cut off the power, then put the iron to a suitable place for cooling, till the temperature of the iron base decreased to a safety range about 50° C., then the iron can be stored.

Because the conventional irons do not has forced-cooling function, according to experiment, the time of the temperature of the iron decreased from 200° C. to 50° C. needs about 30 minutes. While the iron with high temperature placed in rooms is easily caused unnecessary injury if the person running about the iron contacted to the iron carelessly, therefore, for the sake of safety, it is important to rapidly cool the iron after using.

SUMMARY OF THE INVENTION

Accordingly, the primary object of the present invention is to obviate the drawbacks of the conventional irons that they are not safe enough due to the lower heat dissipation speed after using.

this and other objects of the present invention are achieved by providing: an electric iron, based on the electric irons of the prior art, comprising an ironing base, a soleplate is disposed on the bottom of said ironing base; a housing, comprising a shell covered on the upside of said soleplate of said ironing base.

The present invention is characterized in that: a variety of cooling fins are protruded upwardly from the top surface of said soleplate; said shell has at least one first vent. Because the cooling fins are formed on the soleplate, therefore, when the iron is stopped, by the assistant heat dissipation of the cooling fins, the soleplate with high temperature can be cooled rapidly so as to improve the safety of the iron.

The present invention is also characterized in that: the iron further comprises a fan disposed in the chamber of said housing, at least one first vent is arranged in said housing and is communicated with the chamber, and at least one second vent spaced from the first vent, by the rotation of the fan, the air of the outside can be take into the chamber via the second vent and discharged out via the first vent, thereby the soleplate with high temperature also can be cooled rapidly so as to improve the safety of the iron.

It can be seen from the abovementioned description of the present invention that the present invention is to add heat devices to the conventional electric irons, and is to configure at least one vent on the proper position of the housing of the iron, cooperated with cooling fins or fan. Thus the present invention has the following advantages: after using, by the vents in the housing of the iron and the corresponding cooling fins or fan, the ironing base can be cooled rapidly, thus the safety is improved.

DETAILED DESCRIPTION OF THE PREFERRED EMBODIMENT

The preferred embodiment of the present invention will be best understood by the following detailed description when read in conjunction with FIG. 1 to FIG. 4.

Figure 1:
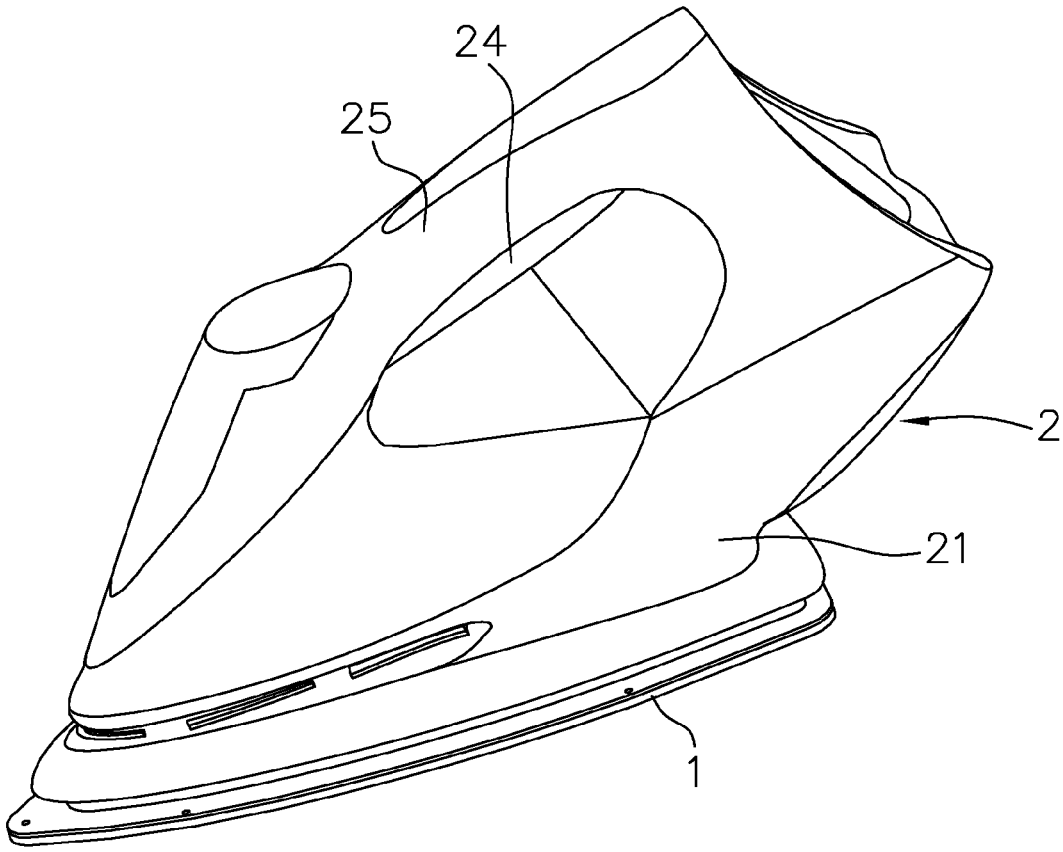
FIG. 1 is a perspective view of the present invention.
Figure 2:
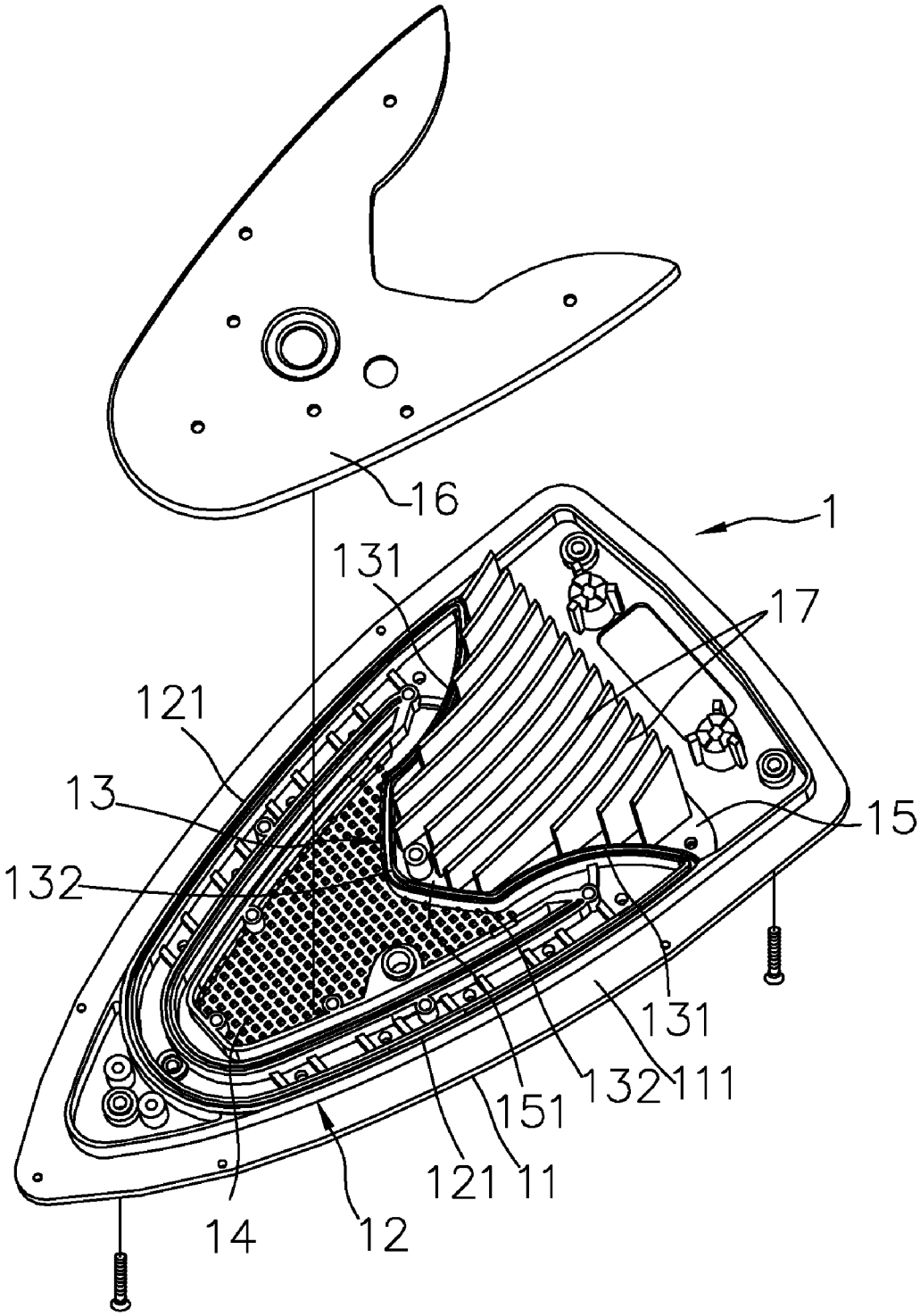
FIG. 2 is a perspective view of the ironing base of the present invention.
Figure 3:
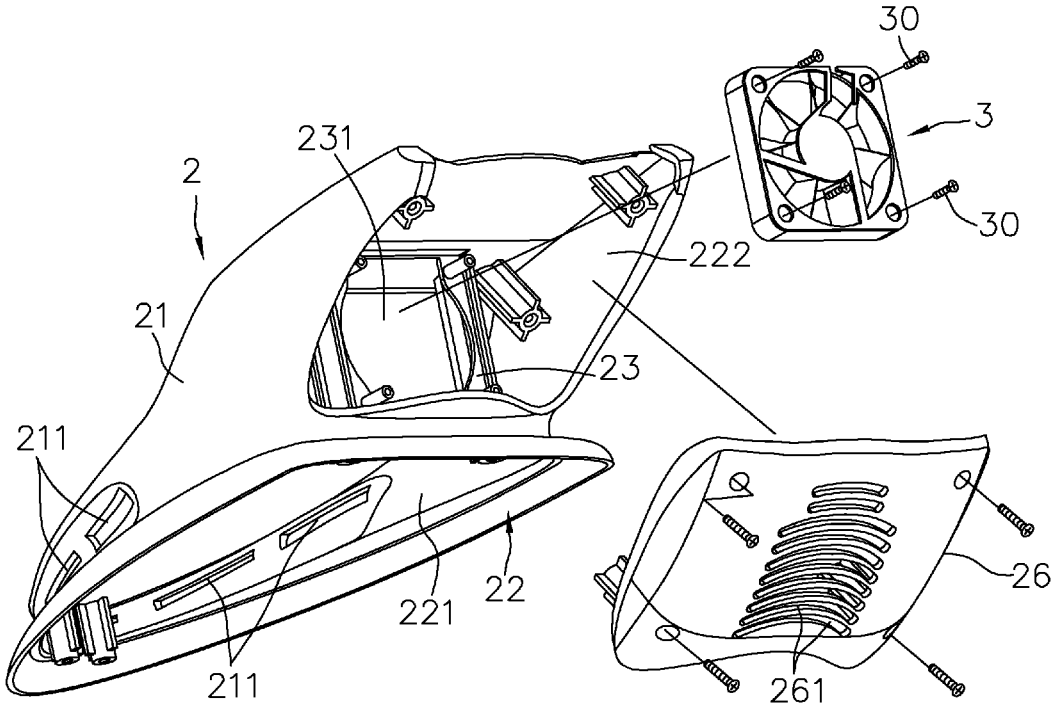
FIG. 3 illustrates the assembly relationship between the housing and the fan of the present invention.

Referring to FIG. 1 to FIG. 3, the electric iron comprises an ironing base 1, a housing 2 fixed on the ironing base 1, and a fan 3 installed inside the housing 2.

The ironing base 1 comprises a ship-shaped soleplate 11 made of metal, a periphery wall 12 configured along the periphery of the soleplate 11 and protruded upwardly from the top surface 111 of the soleplate 11, a partition wall 13 protruded vertically from the top surface 111 and crossly connected between the two side sections 121 of the periphery wall 12, a steam generating area 14 arranged before the partition wall 13, a cooling-fin forming area 15 arranged back the partition wall 13, a steam cover 16 covered over the steam generating area 14, a plurality of cooling fins 17 protrude upwardly from the cooling-fin forming area 15, and a heating member mounted in the steam generating area 14 to heat the soleplate 11. This heating member is well known in the art, so it is not shown in the figures.

Herein the partition wall 13 has two side extending sections 131 which are near the two side sections 121 of the periphery wall 12 respectively and are extended to the central direction, and two middle extending sections 132 which are extended to the central direction also and connected with each other, thereby a front extending zone 151 is formed on the cooling-fin forming area 15. The rear ends of the plurality of cooling fins are aligned to each other, while the height of the fins are increasingly from the front end to the rear end. The front portions of the fins are near the partition wall 13. Because the partition wall 13 is extended forwardly and centrally, the arrangement of the plurality of cooling fins are extended along the length direction of the soleplate 11 and spaced from left to right, and the fin 17 which is nearest to the side section 121 of the periphery wall 12 has the shortest length, while along the partition wall 13, the more near the center, the longer the length of the fin 17.

The heating member of the present invention not only can heat the soleplate 11, but also can heat the water dropping into the steam generating area 14 to be transformed into steam which then can be sprayed out from the bottom of the soleplate 11. This structure is well known in the art and thus is not described herein.

The housing 2 of the electric iron is mounted on the upside of the ironing base 1 by several bolts and can be held for moving the iron. The housing 2 comprises a shell 21 covered on the outer side and the top of the periphery wall 12 of the ironing base 1, a chamber 22 enclosed by the shell 21 and opened downwardly, a fan installing wall 23 which is extended downwardly from the shell 21 and by which the chamber 22 is divided into two parts, a handle 25 which is mounted on the shell 21 and defined a through hole 24 therein, and a fan shell 26 covered on the rear of the shell 21. Herein the shell 21 opened several first vents 211 in the lower portion near the front end, the front zone 221 in the front of the fan installing wall 23 of the chamber 22 is corresponding to the steam generating area 14 and the cooling-fin forming area 15 of the ironing base 1, and the chamber 22 has a rear zone 222 which is in the back of the fan installing wall 23 and protruded out the soleplate 11, an air vent 231 is disposed in the fan installing wall 23 for communicating the front zone 221 and rear zone 222. The fan shell 26 fixedly covered on the rear portion of the shell 21 and closed the rear zone 222, a plurality of second vents 261 are arranged crossly on the fan shell 26 and they are parallel vertically. In manufacture, the fan shell 26 also can be formed integrally with the shell 21.

In practice, the inside of the front zone 221 is provided with devices which are needed for the electric iron such as water reservoir, control circuit etc. These devices are not the essence to the present invention, and thus they are not shown in the figures and not described herein.

The fan 3 is fixed on the fan installing wall 23 by several bolts 30, and rotated to generate an air flow. The air is inhaled into the rear zone 222 via the second vents 261 of the fan shell 26, and is transported through the front zone 221, at last is discharged out via the first vent 211 of the shell 21.

Figure 4:
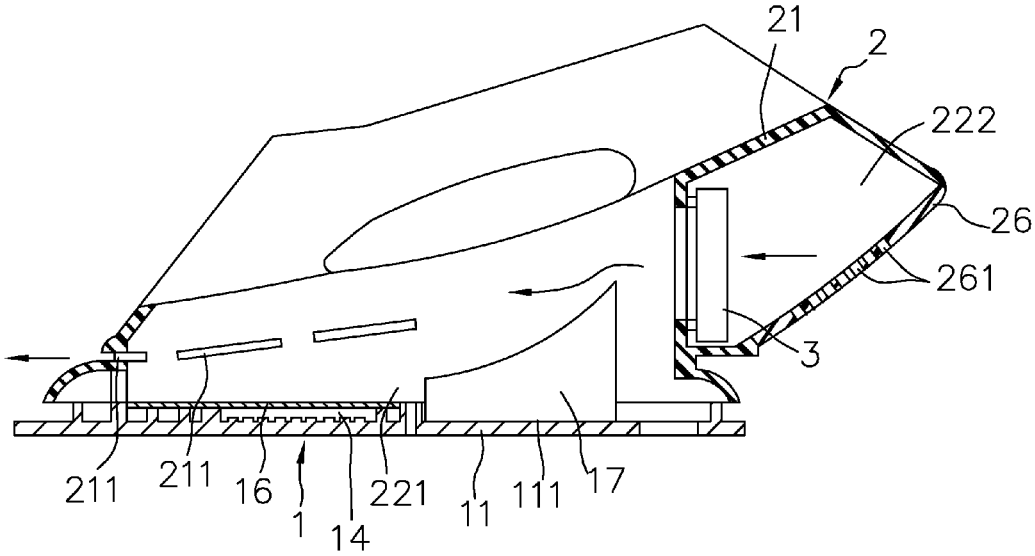
FIG. 4 is a side sectional view of the present invention.

Referring to FIG. 2, FIG. 3 and FIG. 4, in use, the heating member of the electric iron is electrified so as to heat the soleplate to be with a high temperature, and the water dropping into the steam generating area 14 will be heated by the soleplate 11 also to generate steam, then the steam sprayed out from the bottom of the soleplate. This is the general function of the conventional irons and thus is not described in detail for the sake of brevity. The present invention is characterized in that: after the heating member of the electric iron is cut-off, the fan 3 mounted in the chamber 22 will be controlled to move, and the air of the rear of the electric iron is inhaled into the rear zone 222 via the second vents 261, and then enter into the front zone 221 so that the air can be pass through the cooling fins 17 and discharged from the first vents 211 of the housing 2.

According to the experiment proceeded by the inventor, when a temperature of the soleplate 11 is higher to 180~200° C., the fan 3 of the present invention only is needed to work 6 minutes to let the temperature of the soleplate 11 to be decreased to a safety temperature of 50° C. This shortens the time of the conventional irons to be cooled to a safety range greatly, and can effectively improve the storing safety of the electric iron. In the use state in practice, the control way of the fan 3 can be automatic, or manual, i.e., set a control switch on the housing 2 so that after the electric iron is used, the fan 3 can be controlled manually, and when the temperature is decreased to 50° C., the fan 3 will be stopped automatically by a circuit.

In addition, according to the object of the present invention, it is not necessary to have both the fan 3 and the cooling fins 17 to achieve the rapid cooling. In other words, if the ironing base 1 is provided with cooling fins 17 and the housing 2 is provided with at least one vent, or by a design of the heat fan 3 cooperated with vents, these also can achieve the rapidly cooling effect. According to the requirements of the shape, structure or size etc. of the iron, the structure can be selected from the combination of the cooling fins 17, the fan 3 and the vents 211, 261, or the combination of the cooling fins 17 and the vents 261, or the combination of the fan 3 and the vents 211, 261.

It can be seen from the abovementioned description, the structure of the iron provided with cooling fins 17, a fan 3 and vents 211, 261 is a novel structure to the prior art, and after the electric iron is used, the soleplate 11 with high temperature can be cooled rapidly by the heat dissipation devices of the afore structure, thereby avoiding injury by carelessly contacting of the iron, thus the safety of the present invention has been improved really.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

INDUSTRIAL APPLICABILITY

The electric iron capable of quickly cooling of the present invention is based on the conventional iron and is provided with heat dissipation combination such as combination of the cooling fins and the vents, combination of the cooling fins, the vent and the fan, combination of the vents and the fan, the present invention is skillfully constructed, novel designed, and can be conveniently manufactured.

What is claimed is:

1. An electric iron capable of quickly cooling, comprising:
an ironing base;
a soleplate disposed on a bottom of said ironing base;
a plurality of cooling fins protruded upwardly from a top surface of said soleplate, heights of the cooling fins increasing from a front end to a rear end;
a housing, comprising a shell covering the top surface of said soleplate, and a chamber enclosed by said shell for containing said cooling fins, said shell having at least one first vent and at least one second vent spaced from the first vent; and
a fan disposed in the chamber that draws in outside air into said chamber via the second vent and discharges the air out via the first vent.

2. An electric iron capable of quickly cooling, comprising:
an ironing base;
a soleplate disposed on a bottom of said ironing base;
a plurality of cooling fins protruded upwardly from a top surface of said soleplate;
a housing, comprising a shell covering the top surface of said soleplate, and a chamber enclosed by said shell for containing said cooling fins, said shell having at least one first vent and at least one second vent spaced from the first vent; and
a fan disposed in the chamber that draws in outside air into said chamber via the second vent and discharges the air out via the first vent;
wherein said ironing base includes a periphery wall extended upwardly from the top surface of said soleplate, a partition wall crossly connected between said periphery wall, a steam generating area between said periphery wall and said partition wall, and a cooling-fin forming area, wherein said cooling fins are disposed in said cooling-fin forming area.

3. The electric iron capable of quickly cooling according to claim 1, wherein said cooling fins are extended along a length direction of the soleplate and lengths of said cooling fins increase from two sides to a center of said soleplate.

4. The electric iron capable of quickly cooling according to claim 1, wherein said housing further comprises a fan installing wall which is extended downwardly from the shell and divides the chamber into a front zone and a rear zone, the fan installing wall comprising an air vent that passes through the front zone to the rear zone, the fan being mounted on said fan installing wall, and said first vent being disposed in front of said fan.

5. An electric iron capable of quickly cooling, comprising:

an ironing base;

a soleplate is disposed on a bottom of said ironing base;

a plurality of cooling fins protruded upwardly from a top surface of said soleplate, heights of the cooling fins increasing from a front end to a rear end;and a housing, comprising a shell covering the top surface of said soleplate, and a chamber enclosed by said shell for containing said cooling fins, said shell having at least one first vent.

6. The electric iron capable of quickly cooling according to claim 5, wherein said ironing base further comprises a periphery wall extended upwardly from the top surface of said soleplate, a partition wall crossly connected between said periphery wall, a steam generating area between said periphery wall and said partition wall, and a cooling-fin area, wherein said cooling fins are formed in said cooling-fin area.

7. The electric iron capable of quickly cooling according to claim 5, wherein said cooling fins are extended along a length direction of the soleplate and lengths of the fins increase from two sides to a center of said soleplate.

* * * * *